United States Patent [19]

Nessfield

[11] Patent Number: 4,546,945

[45] Date of Patent: Oct. 15, 1985

[54] FREIGHT-CARRYING PLATFORMS

[75] Inventor: Stanley Nessfield, Driffield, England

[73] Assignee: Sea Co Services Limited, London, England

[21] Appl. No.: 373,304

[22] Filed: Apr. 29, 1982

[30] Foreign Application Priority Data

Apr. 30, 1981 [GB] United Kingdom ..... 8113339

[51] Int. Cl.[4] ..... A47G 29/00; B65D 19/38

[52] U.S. Cl. ..... 248/346; 24/287; 108/53.1; 410/32

[58] Field of Search ..... 248/346; 108/53.1, 53.5; 220/23.4; 206/504; 24/287; 410/81, 83, 90, 91, 31, 32; 292/246, 248, 299

[56] References Cited

U.S. PATENT DOCUMENTS

| | | | |
|---|---|---|---|
| Re. 26,873 | 4/1970 | Mollon | 410/91 |
| 922,293 | 5/1909 | Kirchner | 410/81 X |
| 2,488,222 | 11/1949 | Morgan | 292/246 |
| 3,107,634 | 10/1963 | Gutridge | 410/81 X |
| 3,162,320 | 12/1964 | Hitch et al. | 220/23.4 |
| 3,664,273 | 5/1972 | Howe | 108/53 |
| 3,752,511 | 8/1973 | Racy | 24/287 |
| 4,249,840 | 2/1981 | Kallaes et al. | 410/81 X |
| 4,394,101 | 7/1983 | Richer | 410/83 |

*Primary Examiner*—J. Franklin Foss
*Assistant Examiner*—David L. Talbott
*Attorney, Agent, or Firm*—Ladas & Parry

[57] ABSTRACT

Freight carrying platforms are disclosed which can be stacked when empty and interconnected to enable the stack to be handled as a unit by conventional handling equipment for ISO Containers. Each platform has a set of links in the form of closed loops. Each such loop is traversed by a bar rigid with the platform and in the unlinked state hangs down from its bar. During linking, each link is lifted into a slot in the next superimposed platform and engaged by a sliding bolt of the latter. Two types of lateral registration means are disclosed.

7 Claims, 7 Drawing Figures

FREIGHT-CARRYING PLATFORMS

The present invention relates to platforms which can be loaded with freight for transport thereof and which, when empty, can be stacked and connected together to enable them to be handled as a unit. The platform may be a simple flat, generally rectangular base or may be a folding or collapsible container consisting of a base and end frames or corner posts hinged to the base for movement between an erect position in which freight can be carried on the base and a collapsed position in which the end walls or frames or corner posts lie on top of the base to enable a plurality of such platforms to be stacked and linked together to form a unit.

According to the present invention, a platform for carrying freight has a set of links for connecting the platform to an adjacent platform in a stack, each link being biassed to a retracted position in which it does not protrude from the top or bottom surface of the platform but being manually movable against the bias into an extended position in which a portion of the link projects proud of the platform, and the platform includes a bolt movable to engage an aperture of a link of an adjacent platform when the platform and the said adjacent platform are assembled together in a stack.

Advantageously, the link is in the form of a loop, such as a chain link, held captive on a bar secured to the platform structure, the dimensions of the opening through the loop being sufficient to permit movement between the retracted and projecting positions.

Preferably, the platform has registration means for engagement with an adjacent similar platform in a stack to ensure that each platform remains correctly positioned in the stack. The registration means may comprise step formations or retractible elements engageable in apertures of an adjacent platform.

Embodiments of the invention will now be described by way of example with reference to the accompanying drawings, in which.

Figure 1:
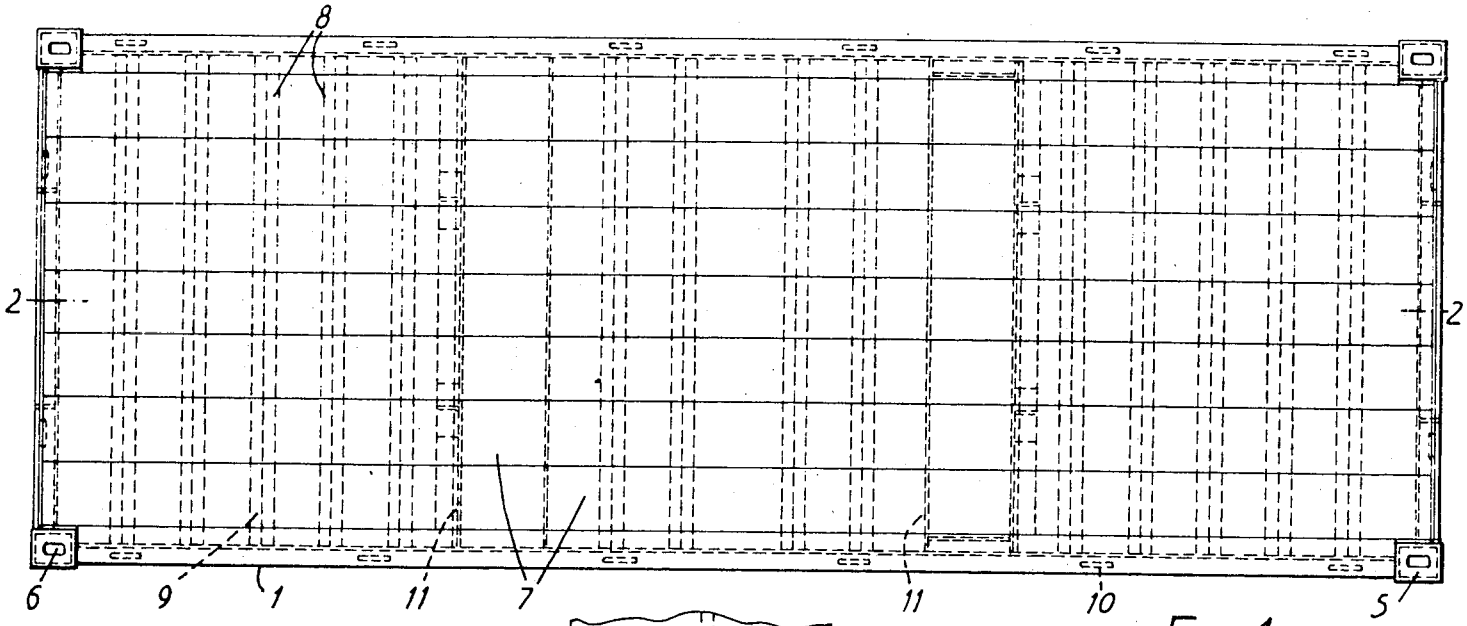
FIG. 1 is a plan view of a goods carrying platform.

The platform shown in FIGS. 1 to 4 of the drawings has a rectangular perimeter frame (FIG. 1) comprising two side members 1 of I-section and two end members 2 of channel-section. At their ends, the side members 1 and end members 2 are welded to corner structures consisting of a bottom corner casting 3 and an upper portion 4 in the form of a rectangular tube which is welded at its lower end to the top face of fthe casting 3 and at its upper end to a lifting plate 5 formed with an aperture 6 for engagement by lifting means conventionally used for lifting ISO containers.

A load-carrying surface for the platform is formed in a conventional manner by planking 7 secured by screws 8 to cross-members 9 welded at each end to the side members 1. Freight on the platform may be secured into position by lashing to lashing bars 10 to which waterproof cover such as tarpaulins can also be secured. The platform may also be equipped with tubular tunnels (indicated at 11) to receive the tines of a fork-lift truck for transporting the platform, particularly when empty.

Figure 2:
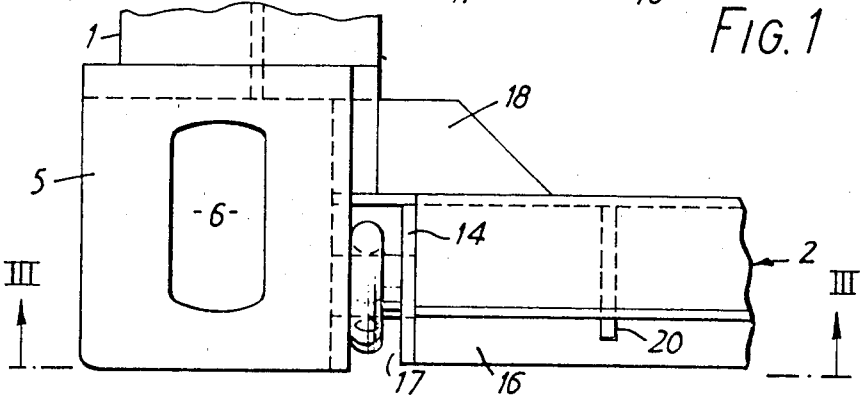
FIG. 2 shows one corner of the platform on an enlarged scale.
Figure 4:
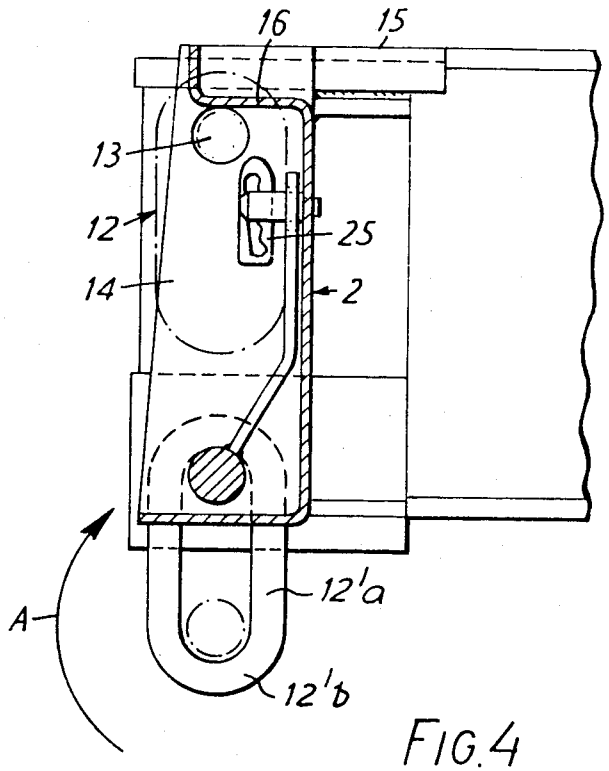
FIG. 4 is a vertical section on the line IV—IV of FIG. 3.

FIGS. 2 and 4 show the arrangement adjacent to one corner of a platform for securing two adjacent platforms in a stack of such platforms to each other (in the empty condition of the platforms). This arrangement is repeated at each corner of the platform.

A link 12 of the kind used to form a chain has two straight sides 12*a* interconnected by semi-circular ends 12*b* forming a closed loop with an opening therethrough. The link 12 is rendered captive by a bar 13 which is welded at one end to the corner tube 4 and at its other end to a bracket plate 14 welded to the channel-section end member 2.

Figure 3:
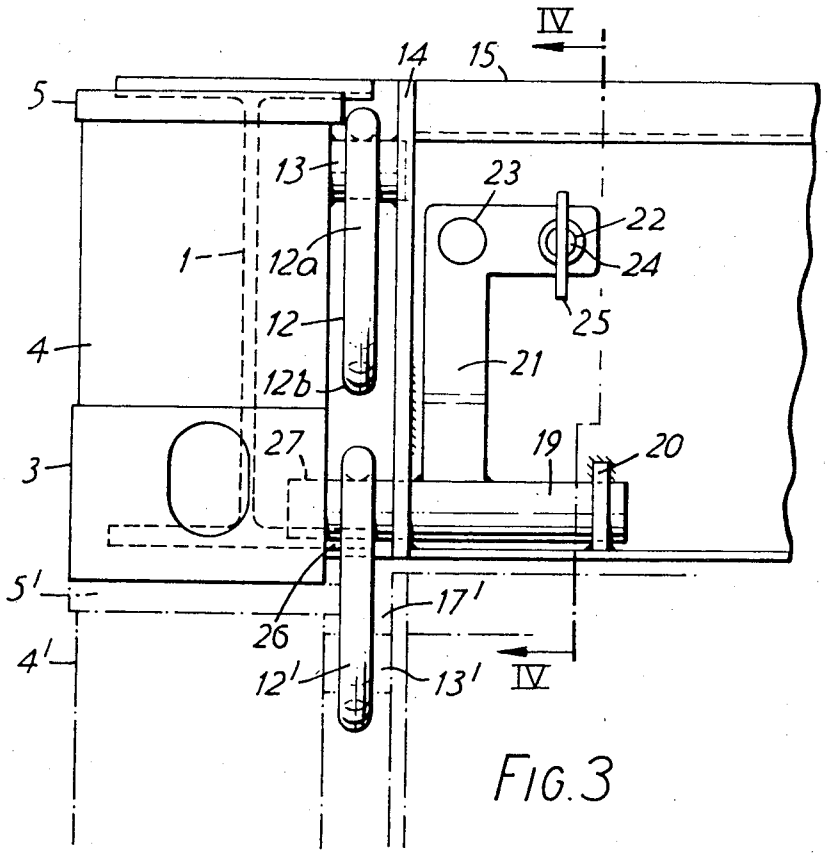
FIG. 3 is a vertical elevation view in the direction of the arrows III of FIG. 2.

When no platform is superimposed on the platform, the link 12 hangs down from the bar 13 as shown in FIGS. 3 and 4 and does not project above the load carrying surface 15. However, the top flange portions 16 above the chain link 12 are cut away to form a slot 17 through which the link can be swung or pushed upwards by hand to project above the surface 15. To compensate for the loss of the top flange 16 at this point, a gusset plate 18 is welded between the inner face of the end member 2 and the corner tube 4.

As shown in FIGS. 3 and 4, the unloaded platform has been lifted, for example by means of a fork-lift truck or by means of a top lifting device engaged with the opening 6, and lowered onto the top of an identical, lower platform.

To enable the two platforms to be connected together by means of the links 12' of the lower platform, the upper platform (and of course also the lower platform) has a bolt 19 slidable in aligned holes in the bracket 14 and a further bracket 20 welded to the end member 2. The bolt 19 carries an operating handle 21 formed with two apertures 22, 23 either of which can be engaged over a pin 24 fixed to the end member 2, the pin 24 carrying a captive fastener 25 movable between the upright locking position shown in FIGS. 3 and 4 and a horizontal position permitting the handle to be disengaged from the pin 24. With this arrangement, the bolt 19 can be secured either in its locked position shown in FIG. 3 or in an unlocked position in which the pin is engaged through the hole 23. In the latter position, the chain link 12' of the lower platform can be lifted or swung as indicated by the arrow A in FIG. 4 into its projecting position in which it extends through the notch 17' of the lower platform and a similar notch 26 in the lower flange of the end member 2 of the upper platform into a position in which the uppermost part of the opening of the lower link 12' is aligned with the bolt 19. The latter can then be moved (to the left) into the position shown in FIG. 3 in which the left-hand end of the bolt extends through the link 12' into a socket hole 27 drilled into the corner casting 3. The bolt 19 is then secured in this position by turning the bolt 19 by means of the handle until the latter is engaged by means of its hole 22 over the pin 24 for retention by the locking element 25.

Thus, a stack of platforms when connected together at each corner in the manner described above, can be lifted as a unit by lifting the uppermost platform. It can be seen from FIGS. 3 and 4 that the top surface of the lifting plates 5 is slightly below the load carrying surface of the platforms and that the bottom surface of the bottom corner castings 3 lies below the bottom surfaces of the side and end members 1 and 2. This arrangement provides a snug nesting fit and longitudinal location and registration of one platform relative to its neighbour or neighbours.

This arrangement reduces or eliminates the application of longitudinal and transverse racking forces to the links, these racking forces being instead transferred directly from one platform to the next by their snug nesting engagement with each other.

When required for loading, the platforms in a unit can be quickly separated by disengaging the catch elements 25, pulling the handle 21 clear of the pin 24 and then sliding the bolt 19 by means of the handle to disengage the bolt from the hole 27 and from the link 12'. The latter then drops down through the notches 26 and 17 into a retracted position in which its upper end rests on the bar 13' of the lower platform. The upper platform can then be lifted away by a fork-lift truck or other lifting device.

Figure 5:
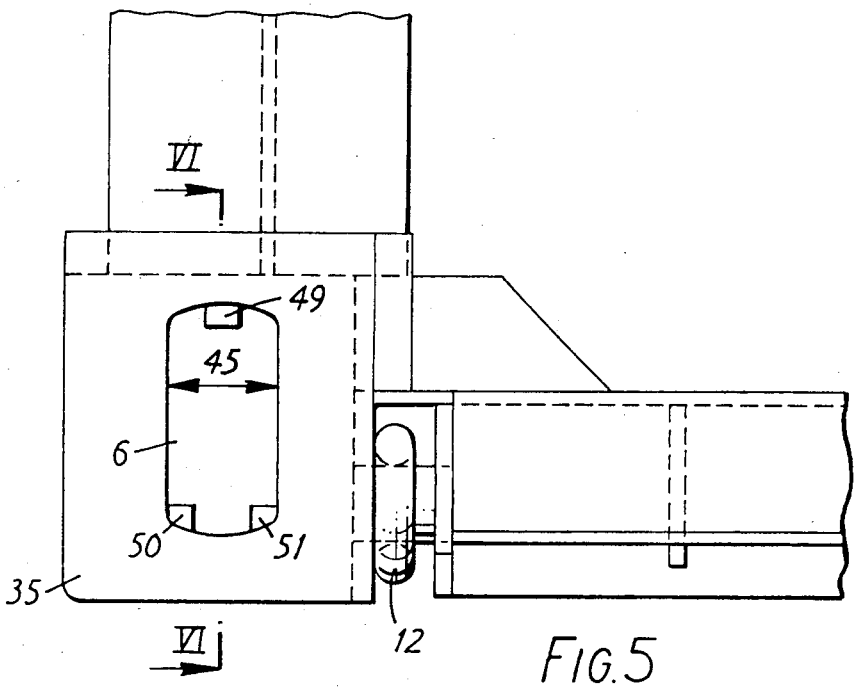
FIG. 5 is a view similar to FIG. 2 but of a modified platform.
Figure 6:
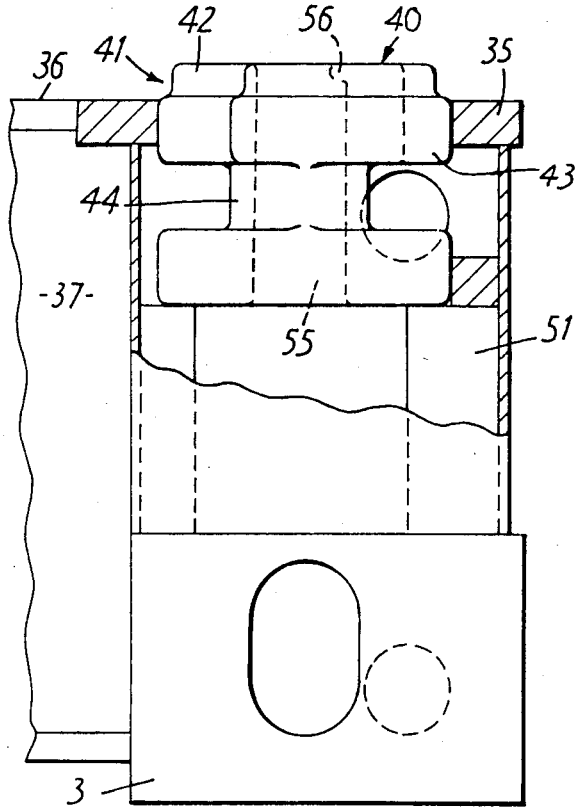
FIG. 6 is a view partly in elevation and partly in section on the line VI—VI of FIG. 5.
Figure 7:
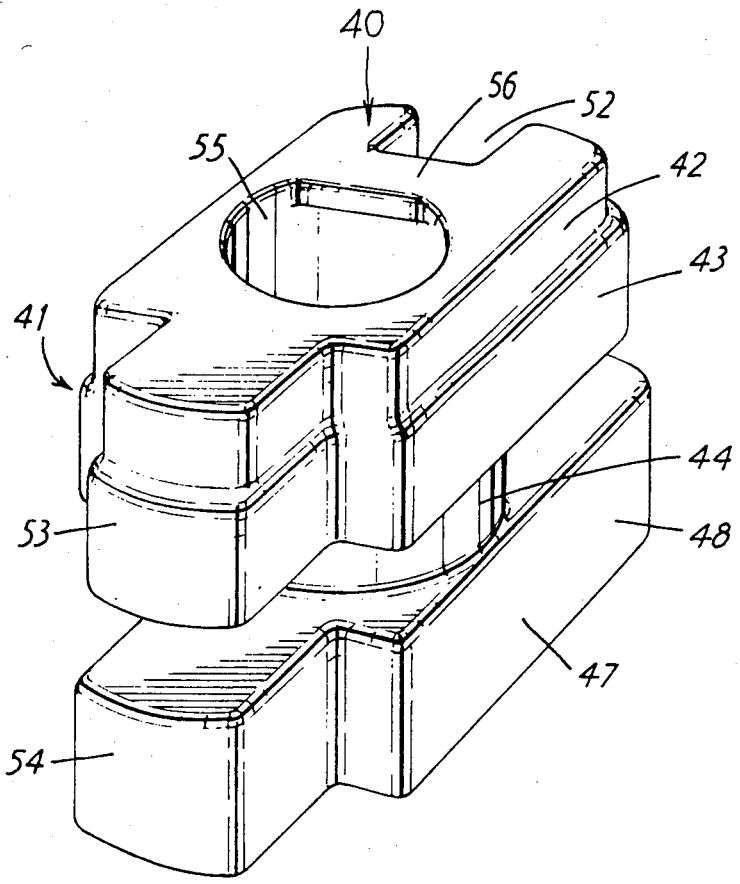
FIG. 7 is a perspective view of the retractible registration spigot shown in FIG. 6.

In the modified corner construction shown in FIGS. 5—7, the prop plate 35 is flush with the top surface 36 of the platform and with the top of the top flange of the perimeter beams of the platform. This enables the empty platform to be lifted by all existing prop-lifting spreader equipment. With this arrangement, the lateral location and registration between super-imposed platforms of the kind shown in FIGS. 1–4 is not available. Instead, this function is performed by retractable spigot members 40 which are located in at least two, diagonally opposed, corners of the platform. Each spigot member 40 is vertically movable in its corner between an upper position in which a spigot head portion 41 projects upwards through the aperture 6 for engagement in a corresponding aperture in the bottom corner casting 3 of a super-imposed platform, and a lower position in which the spigot member 40 is retracted and rests on top of the bottom corner casting 3. As can be seen in FIGS. 6 and 7, the uppermost portion 42 of the head 41 of the spigot member 40 which in the extended position projects above the top plate 35 is of slightly reduced horizontal dimensions as compared with the lower portion 43 of the head 41 to facilitate entry of the uppermost portion 42 into the aperture in the super-imposed bottom corner casting 3.

Beneath the head 41, the spigot member 40 has a central cylindrical waist 44 of diameter slightly less than the width 45 (FIG. 5) of the top aperture 6 and the plate 35, and a bottom portion 47 of generally similar profile to the head 41 but projecting on one side 48 further than the head 41.

In its uppermost, projecting position, the bottom portion 47 rests on the top surfaces of three vertical ribs 49, 50 and 51 extending upwards from the top face of the bottom corner casting 3. Each spigot member 40 has a central channel 52 extending for the full height of the spigot member, on one side, of width slightly greater than the width of the rib 49. At its opposite side, the spigot member has lobe portions 53 and 54 respectively of the head 41 and bottom portion 47, these lobe portions both having a width slightly less than the distance between the ribs 50 and 51.

In the upper, extended position shown in FIG. 6, the lower lobe 54 rests on top of the rib 49 while the projections formed by the part 48 on each side of the channel 52 rest on the tops of the ribs 50 and 51. The spigot member 40 can be moved from this position to a lower, retracted position in which a crane hook or twist lock of a lifting spreader can be engaged in the opening 6. For this purpose, the spigot member is lifted to bring its waist 44 into alignment with the top plate 35. The spigot member 40 can then be turned through 180° to bring the channel 52 into register with the rib 49 and the lobes 53 and 54 into register with the space between the ribs 50 and 51. The spigot. member 40 can then be lowered to rest on the top face of the bottom corner casting 3, leaving the top aperture 6 unobstructed. To assist manipulation of the spigot member 40, it is formed with a central bore 55 having a chordal lip 56 extending across the top adjacent the channel 52. The greater radial extent of the part 48 of the bottom portion 47 engages the under side of the top plate 35 when the spigot member 40 is lifted and thereby prevents accidental removal of the spigot member through the top plate 35.

To move the spigot member from its lower retracted position to its upper projecting position, it is merely necessary to lift the spigot member again to the position in which the waist 44 registers with the top plate 34, turn the spigot member through 180° and then lower it to rest on the top faces of the ribs 49, 50 and 51.

I claim:

1. A platform for carrying freight having a fixed frame with ISO corner units mounted in the frame and a plurality of releasable connection means mounted in the frame and distanced from the ISO corner units for connecting the platform to an adjacent platform in a stack, each releasable connection means comprising a pin and receiving member having an aperture so that the pin of the platform engages the aperture of a receiving member of an adjacent platform when the platform and the adjacent platform are assembled in a stack, wherein each aperture receiving member is a link movable relative to the frame of the platform and is biassed to a retracted position in which it does not protrude from the top or bottom surface of the platform and is manually movable against the bias into an extended position in which a portion of the link projects proud of the platform and a bolt mounted on the platform and being movable within the extremities of the frame to engage the aperture of a corresponding link of an adjacent platform when the corresponding link is in its extended position to enable the platform and the aid adjacent platform to be locked one relative to the other when assembled together in a stack.

2. The platform of claim 1 in which the link is in the form of a closed loop held captive on a bar secured to the platform structure, the dimensions of the opening through the loop being sufficient to permit movement between the retracted and projecting positions.

3. The platform of claim 2 in which said loop is a chain link.

4. The platform of claim 1, in which top and bottom surfaces of said platform have registration means for registration with similar registration means respectively on the bottom and top surfaces of similar platforms stacked respectively above and below said platform.

5. The platform of claim 4 in which said registration means comprise openings in the bottom surface adjacent corners thereof and retractible spigot members located in passages extending up through top openings in the top surface of said platform, said top openings and said passages being aligned with at least some of said openings in said bottom surface.

6. The platform of claim 5 in which said spigot members have a head portion adapted to protrude from said top openings in an upper, operative position of said spigot member, a waist portion permitting said spigot member to tunnel about its vertical axis when in a further raised position and a lower portion adapted to seat on top surfaces of internal profiling of said platform when the spigot is in a predetermined orientation in its operative position, said spigot member having an external contour permitting downward movement through said profiling into a retracted position when said spigot member has a different orientation.

7. A platform for carrying freight including a fixed frame supporting flooring means on which freight is loadable, an ISO corner unit mounted at each corner of the frame for assisting connection of the platform to lifting spreader equipment with twistlock devices effecting connection therebetween, a movable link in the form of a continuous loop mounted on a bar of the frame and distanced from the ISO corner units, the bar passing through the opening of the loop, the link being biassed to a retracted position in which it does not protrude from the top or bottom surface of the frame and being manually movable to an extended position against the bias in which a portion of the link projects proud of the platform, and a bolt movably mounted on the frame within the extremities of the frame and independent of the movable link at each corner of the frame, each bolt being movable to engage the opening of a corresponding link of an adjacent platform when the platform and the said adjacent platform are assembled together in a stack.

* * * * *